US008950995B2

(12) United States Patent
Nakanishi et al.

(10) Patent No.: US 8,950,995 B2
(45) Date of Patent: Feb. 10, 2015

(54) MACHINE FOR ATTACHMENT OF COVER TO BOOK BLOCK AND BOOK BINDING APPARATUS HAVING THE SAME

(75) Inventors: Hirohito Nakanishi, Shiga (JP); Kou Ohuchiyama, Shiga (JP); Takehito Yokogi, Shiga (JP); Akira Onodera, Shiga (JP)

(73) Assignee: Horizon International Inc., Shiga (JP)

( * ) Notice: Subject to any disclaimer, the term of this patent is extended or adjusted under 35 U.S.C. 154(b) by 57 days.

(21) Appl. No.: 13/991,549

(22) PCT Filed: Aug. 24, 2011

(86) PCT No.: PCT/JP2011/069062

§ 371 (c)(1),
(2), (4) Date: Jun. 4, 2013

(87) PCT Pub. No.: WO2013/027279

PCT Pub. Date: Feb. 28, 2013

(65) Prior Publication Data

US 2013/0259607 A1 Oct. 3, 2013

(51) Int. Cl.
*B42C 13/00* (2006.01)
*B42C 11/04* (2006.01)

(52) U.S. Cl.
CPC ..... *B42C 11/04* (2013.01)
USPC ..... 412/22; 412/4; 412/5; 412/18; 412/19; 412/21

(58) Field of Classification Search
CPC ..... B42C 13/00; B42C 11/04
USPC ..... 412/4–5, 18–19, 21–23
See application file for complete search history.

(56) References Cited

U.S. PATENT DOCUMENTS

| | | | | |
|---|---|---|---|---|
| 7,845,890 | B2 * | 12/2010 | Sasamoto et al. | 412/5 |
| 8,613,581 | B2 * | 12/2013 | Winkelmann et al. | 412/19 |
| 2009/0245975 | A1 | 10/2009 | Hattori | |
| 2010/0189530 | A1 * | 7/2010 | Kojima | 412/19 |

FOREIGN PATENT DOCUMENTS

| | | | |
|---|---|---|---|
| JP | 2009-227439 | A | 10/2009 |
| JP | 2010-173070 | A | 8/2010 |
| JP | 2011-031533 | A | 2/2011 |

OTHER PUBLICATIONS

International Search Report for PCT/JP2011/069062, mailing date of Oct. 4, 2011.

* cited by examiner

*Primary Examiner* — Kyle Grabowski
(74) *Attorney, Agent, or Firm* — Westerman, Hattori, Daniels & Adrian, LLP

(57) ABSTRACT

A machine for attachment of a cover to a book block comprises a press plate elevating mechanism for elevating a press plate 8, a nip plate drive mechanism for sliding nip plates 9 and 10, and a controller 30 controlling the press plate elevating mechanism and the nip plate drive mechanism. The press plate 8 elevates from the lower standby position to an upper press position. The press plate 8 presses the cover 12 to the book block 4 at the upper press position. The cover 12 is attached to the book block 4 by pressing the cover 12 to the lower end surface of the book block 4. The press plate 8 is elevated from the intermediate position to the upper press position, staying at the intermediate position during a waiting time for adjustment. The press plate 8 elevates from the intermediate position to the upper press position.

8 Claims, 11 Drawing Sheets

MACHINE FOR ATTACHMENT OF COVER TO BOOK BLOCK AND BOOK BINDING APPARATUS HAVING THE SAME

TECHNICAL FIELD OF THE INVENTION

The present invention relates to a machine for attachment of a cover to a book block and a book binding apparatus having the same.

BACKGROUND OF THE INVENTION

As one of book binding processes, there is a cover attachment process of attaching a cover to a book block. In this process, a machine for attachment of a cover to a book block is used (see for example Patent Document 1). The machine includes a vertically movable press plate, and a pair of nip plates arranged on an upper surface of the press plate.

In the cover attachment process, the book block is held by a clamp unit above the pair of nip plates in such a manner that a lower end surface (a back surface) of the book block is opposed to a gap between the pair of nip plates and directed downward. The press plate is disposed at a lower standby position, and glue is applied to the lower end surface of the book block. When the press plate moves upward from the lower standby position to an upper press position, the cover is pressed against the lower end surface of the book block. While the press plate presses the cover against the lower surface of the book block, the nip plates nip both the book block and the cover in such a manner that the cover is pressed against both sides of a lower end portion of the book block, and the cover is attached to the book block.

In some conventional machines an operator can set a time ("a waiting time for nipping") for which the press plate stays at the lower standby position, and a time ("a duration time for nipping") for which the nip plates nip both the book block and the cover, so that the glue applied to the lower end surface of the book block can be dried to a predetermined cure degree. The lower end surface of the book block applied with the glue is held by the clamp unit, then the press plate moves upwardly from the lower standby position to the upper press position after the elapse of the waiting time for nipping. And the cover is pressed against the lower end surface of the book block. Thereafter, the nip plates nip both the book block and the cover, and move away from each other after the elapse of the duration time for nipping, so that the cover is attached to the book block.

In some conventional machines an operator can also set a time (a waiting time for producing a book without a cover) for which the glue dries. The machine generates an alarm signal in the form of sound and/or light to alarm to operators that the time has already passed.

The cover is pressed against the lower end surface of the book block by the press plate so as to attach the cover to the lower end surface of the book block with the glue, and the glue applied to the lower end surface of the book block is extruded to both sides of the lower end surface of the book block. Furthermore the cover is attached to the both sides of the lower end portion of the book block with side glue by the nip plates. As shown in FIG. 11A, the cover 12 is attached to both the lower end surface of the book block 4 and the both sides of the lower end portion thereof so that a book with beautiful appearance is produced.

However, depending on a viscosity of glue and/or a condition of an ambient temperature and so on, the conventional machine cannot sometimes produce the excellent finished book. As shown in FIG. 11B, due to a shortage of the side glue 40 of the both sides of the lower end portion of the book block 4, the cover 12 is attached only to the lower end surface of the book block 4, or as shown in FIG. 11C, the glue 40 is entered into the book block 4 so that there is a problem that a book with the cover 12 of poor appearance may be produced.

Patent Document 1: JP 2010-173070

SUMMARY OF THE INVENTION

Problems to be Solved by the Invention

It is an object of the present invention to provide a machine for attachment of a cover to a book, which can produce a book with a cover of good appearance independent of the viscosity of glue and so on.

Solution to the Problems

In the first invention, a machine for attachment of a cover to a book block comprises: a frame; a press plate attached to the frame to be vertically reciprocated between a lower standby position and an upper press position; a press plate elevating mechanism attached to the flame for elevating the press plate; a pair of nip plates disposed in parallel to each other on an upper surface of the press plate to be slid toward and away from each other; a nip plate drive mechanism attached to the press plate for sliding the nip plates; a clamp unit mounted on the frame for clamping a book block at both side thereof in such a way that a back surface of the book block to which glue is previously applied is directed downward, the clamp unit positioning the book block above a gap between the plates in such a way that the back surface of the book block is opposed to the gap, a cover being arranged over the press plate; and a controller controlling the press plate elevating mechanism and the nip plate drive mechanism, whereby the press plate together with the nip plates elevates from the lower standby position to an intermediate position adjacent to the upper press position, the press plate stays at the intermediate position during a waiting time for adjustment, the press plate together with the nip plates elevates from the intermediate position to the upper press position, and then the nip plates move toward each other so as to attach the cover to the book block.

The controller includes a touch screen for receiving an input of a value of the waiting time for adjustment to control the press plate mechanism.

In the second invention, a machine for attachment of a cover to a book block comprises: a frame; a press plate attached to the frame to be vertically reciprocated between a lower standby position and an upper press position; a press plate elevating mechanism attached to the flame for elevating the press plate; a pair of nip plates disposed in parallel to each other on an upper surface of the press plate to be slid toward and away from each other; a nip plate drive mechanism attached to the press plate for sliding the nip plates; a clamp unit mounted on the frame for clamping a book block at both side thereof in such a way that a back surface of the book block to which glue is previously applied is directed downward, the clamp unit positioning the book block above a gap between the plates in such a way that the back surface of the book block is opposed to the gap, a cover being arranged over the press plate; and a controller controlling the press plate elevating mechanism and the nip plate drive mechanism, whereby the press plate together with the nip plates elevates from the lower standby position to an intermediate position adjacent to the upper press position at a first speed, the press plate together with the nip plates elevates from the intermediate position to the upper press position at a second speed lower than the first speed, and then the nip plates move toward each other so as to attach the cover to the book block.

The controller includes a touch screen for receiving an input of a value of the second speed to control the press plate elevating mechanism.

A book binding apparatus comprises: a milling unit for grinding the back surface of the book block; a glue application unit for applying glue to the back surface of the book block grinded by the milling unit; and a cover attachment unit comprising the machine for attachment of the cover to the book block according to any one of claims 1 to 4, the cover attachment unit attaching the cover to the back surface of the book block to which the glue is applied by the glue application unit, the milling unit, the glue application unit and the cover attachment unit being sequentially arranged in a line, the cover attachment unit having the function of a book block insertion unit for setting the book block in the clamp unit, the clamp unit being guided by a slide guide arranged in parallel to the line to the line of the milling unit, the glue application unit and the cover attachment unit having the function of the book block insertion unit to reciprocate between the milling unit and the cover attachment unit, the book block being inserted to the clamp unit, the back surface of the book block being positioned by being abutted against the press plate when the clamp unit is positioned at the book block insertion unit, the back surface of the book block being then clamped by the clamp unit and moved to the milling unit from the book block insertion unit beyond the glue application unit, the book block being then moved from the milling unit to the cover attachment unit through the glue application unit, the back surface of the book block being processed by the grinding, applied with the glue and attached with the cover during the movement.

Effect of the Invention

In the machine of the invention the intermediate position is provided. The intermediate position is adjacent to the upper press position. Furthermore the intermediate position is disposed between the lower standby position and the upper press position. The machine of the first invention elevates the press plate from the lower standby position to the intermediate position, and stays the press plate at the intermediate position during a waiting time for adjustment, and then elevates the press plate from the intermediate position to the upper press position. The machine of the second invention elevates the press plate from the lower standby position to the intermediate position at a first speed, and then elevates the press plate from the intermediate position to the upper press position at a second speed lower than the first speed.

As a result, even if the glue has a high viscosity and so on, the glue applied to the lower end surface of the book block can be appropriately extruded to the both sides of the lower end portion of the book block, and the cover is attached to the lower end surface of the book block and the both sides of the lower end portion of the book block. At the same time, the press plate is elevated to the upper press position after the glue is extruded to the both sides of the lower end portion of the book block, whereby the press plate is prevented from elevating with a great amount of the glue applied to the lower end surface of the book block. And the glue applied to the lower end surface of the book block is not rapidly subjected to an extra pressure. The glue can be prevented from being entered into the book block. Therefore the machine of the present invention can appropriately extrude the glue to the both sides of the lower end portion of the book block, and can prevent the glue from entering into the book block. Consequently, the machine can produce a book with a cover of beautiful appearance.

DETAILED EXPLANATION OF THE PREFERRED EMBODIMENTS

A machine for attachment of a cover to a book block and a book binding apparatus having the same according to the present invention will be explained below with reference to the accompanying drawings.

The First Embodiment

At first, the first embodiment of the machine according to the present invention will be explained.

[Structure]

Figure 1:
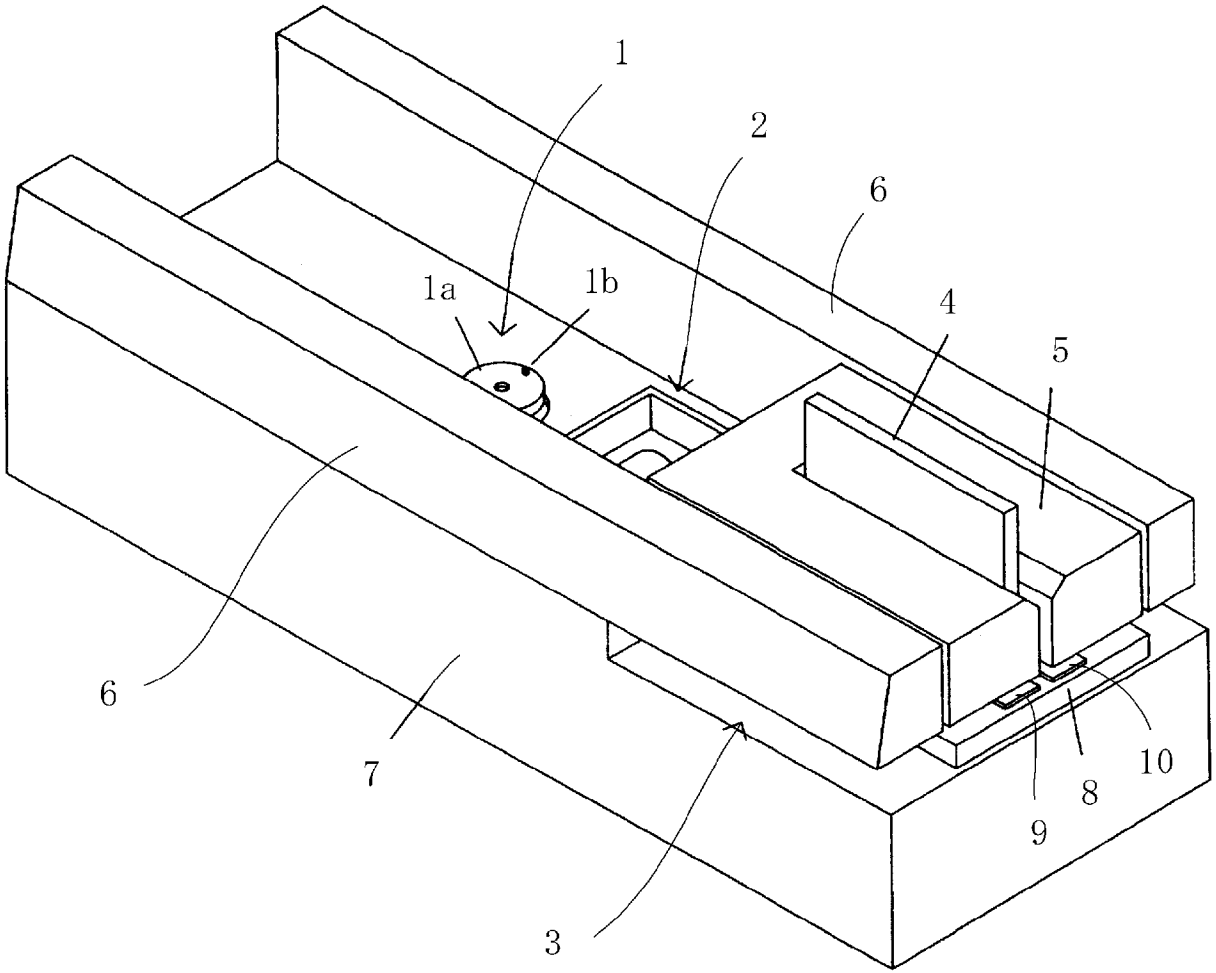
FIG. 1 is a perspective view of a book binding apparatus for perfect book binding having a machine for attachment of a cover to a book block, where a clamp unit is positioned at one end point of a motion path.
Figure 2:
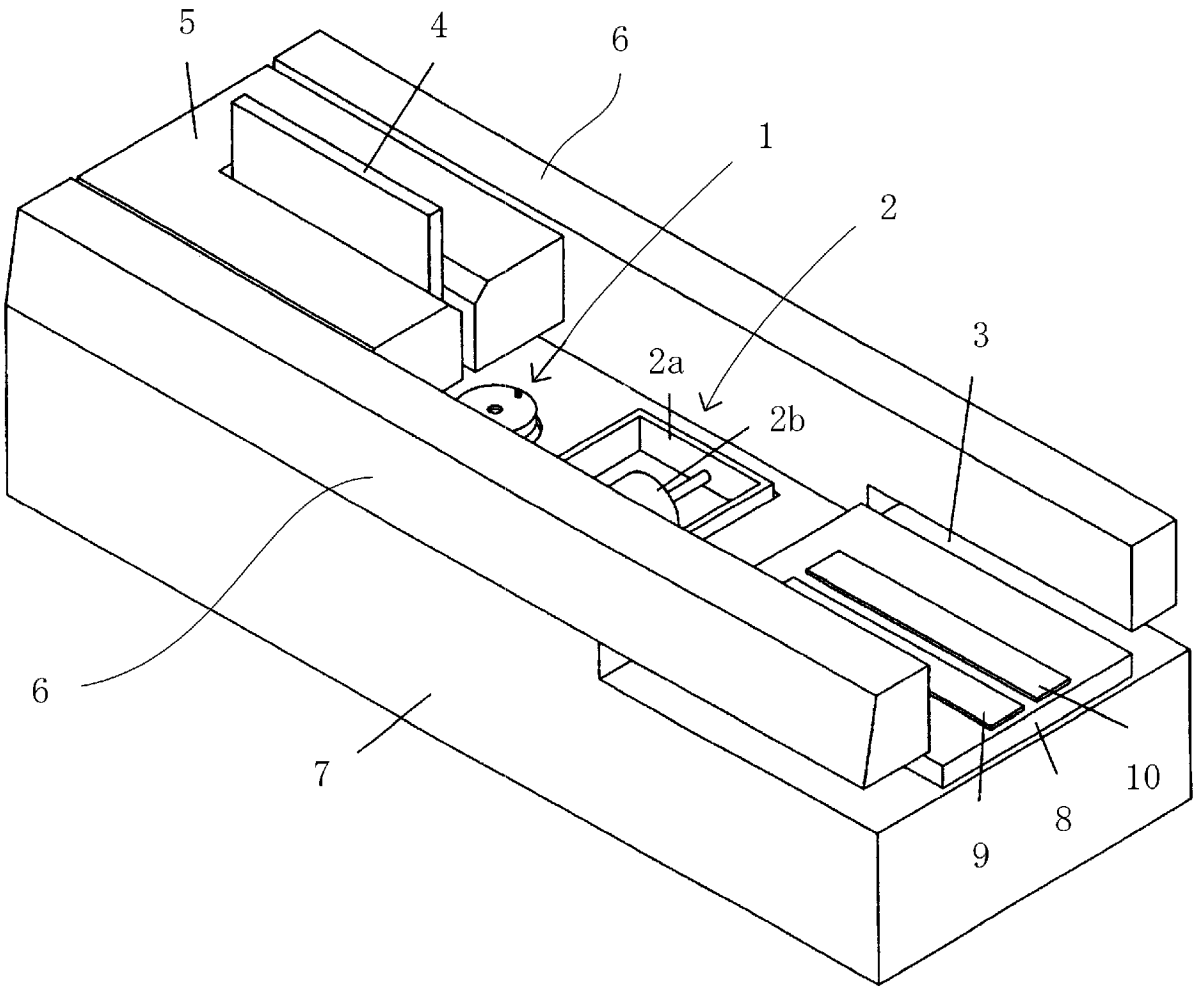
FIG. 2 is a perspective view of a book binding apparatus, where the clamp unit is positioned at the other end point of the motion path.

As shown in FIGS. 1 and 2, the book binding apparatus for perfect book binding includes a milling unit 1, a glue application unit 2, a cover attachment unit 3 comprising a machine for attachment of a cover to a book block according to the present invention, and a clamp unit 5. The milling unit 1, the glue application unit 2 and the cover attachment unit 3 are sequentially mounted in a line on a frame 7. The clamp unit 5 clamps a book block 4 at both sides thereof in such a manner that a back surface of the book block 4 is directed downward above the line, and the clamp unit 5 moves the book block 4 along this line. In this book binding apparatus for perfect book binding, the cover attachment unit 3 also functions as a book block insertion unit for setting the book block 4 in the clamp unit 5.

Although not shown in the drawings, the clamp unit 5 includes a pair of movable clamping plates, and a gap adjusting mechanism for causing the movable clamping plates to move toward and away from each other.

A milling unit 1 includes a milling machine 1*a* and a grinding blade 1*b* provided on the milling machine 1*a*. While the book block 4 passes through the milling unit 1, a back surface of the book block 4 is uniformly grinded by the milling machine 1*a*, and grooves with broad pitch are formed on the grinded back surface of the book block 4 by the grinding blade 1*b*.

The glue application unit 2 includes a glue tank 2*a* filled with glue such as hot-melt adhesive, and a gluing drum 2*b* provided in the glue tank 2*a*. The glue application unit 2 applies glue to a back surface of a book block 4 grinded by the milling unit 1.

Although not shown in the drawings, the glue tank 2*a* and the gluing drum 2*b* can be moved in vertical direction between a position where they are engaged with the book block 4 moved by the clamp unit 5 and a position where they retreat from the book block 4.

A pair of slide guides 6 is attached to the frame 7. The pair of slide guides 6 is arranged in parallel to each other on both sides of the line of the milling unit 1, the glue application unit 2 and the cover attachment unit 3 having the function of the book block insertion unit. The clamp unit 5 is guided by the pair of slide guides 6. The clamp unit 5 is arranged above the line of the milling unit 1, the glue application unit 2 and the cover attachment unit 3, and reciprocates between the milling unit 1 and the cover attachment unit 3. The book binding apparatus also includes a controller 30 (see FIG. 5). The controller 30 controls the milling unit 1, the glue application unit 2, the cover attachment unit 3 having the function of the book block insertion unit, and the clamp unit 5.

Figure 3:
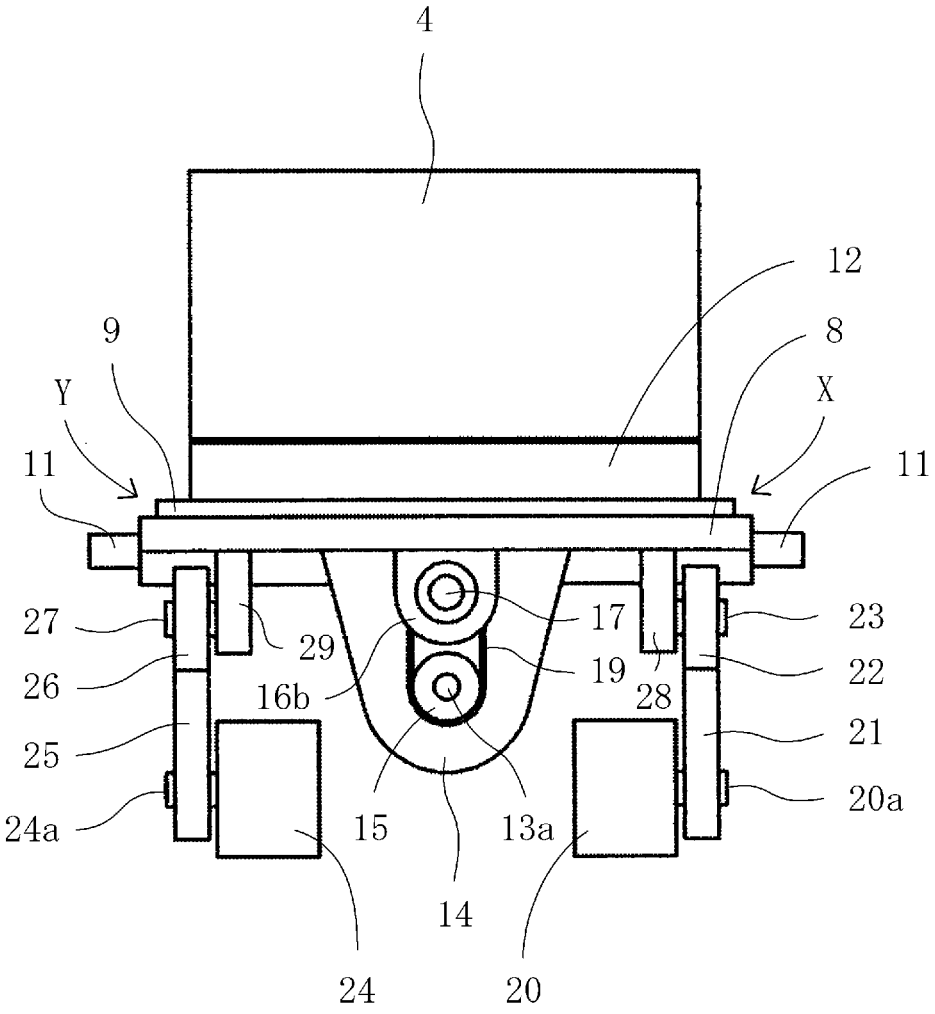
FIG. 3 is a front view showing a structure of the machine.
Figure 4:
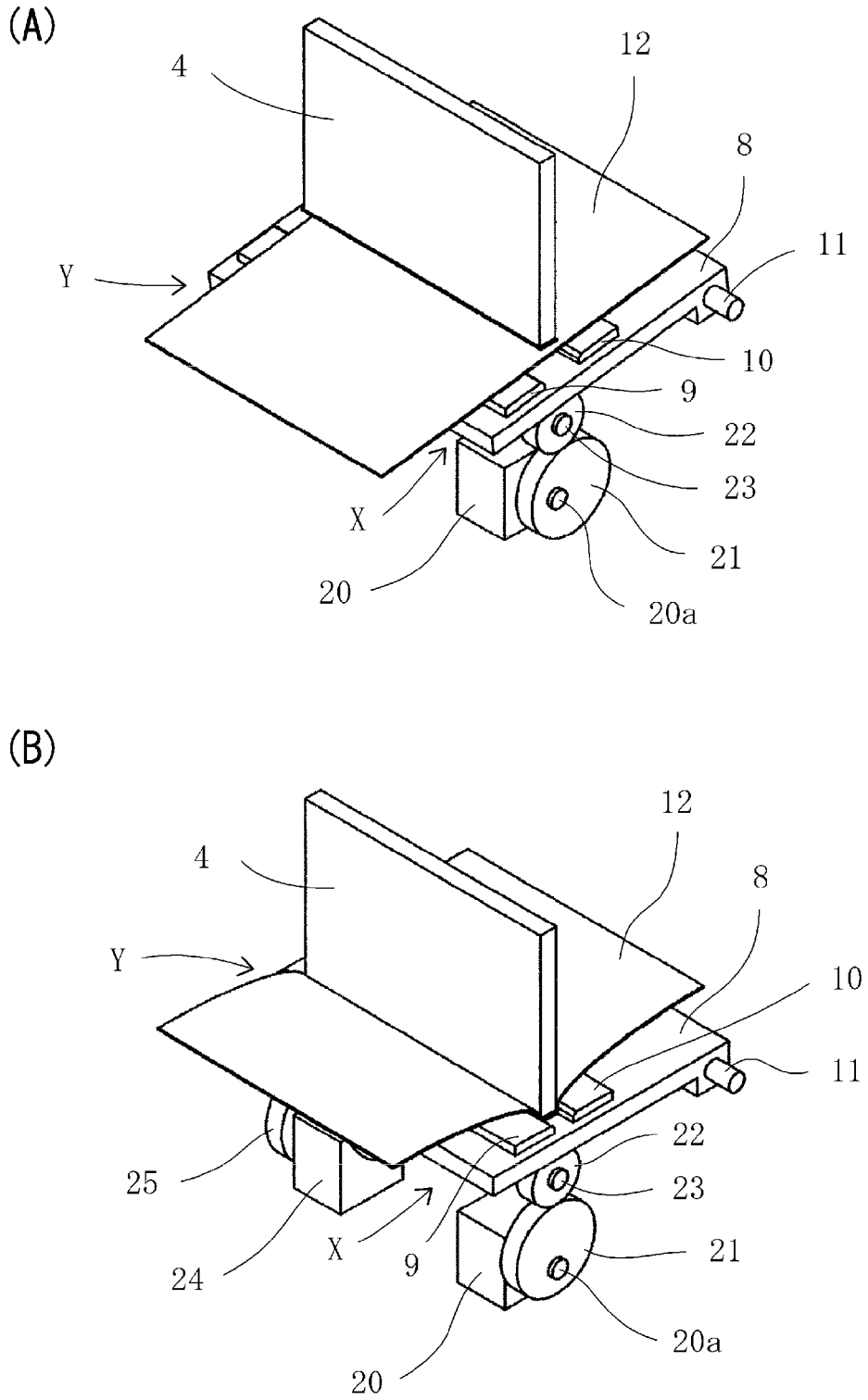
FIG. 4A is a perspective view showing the machine when a press plate is positioned at a lower standby position.
FIG. 4B is a perspective view showing the machine when the press plate is positioned at an upper press position.

As shown in FIGS. 3 and 4, the machine for attachment of the cover to the book block of the present invention comprises a press plate 8 mounted on the frame 7 for vertically reciprocating between a lower standby position and an upper press position, a press plate elevating mechanism mounted on the frame 7 for movement of the press plate 8, and a pair of nip plates 9 and 10 arranged on an upper surface of the press plate 8 in parallel to each other. The pair of nip plates 9 and 10 can slide in directions toward and away from each other. The machine also comprises a nip plate drive mechanism attached to the press plate 8 for causing the pair of nip plates 9 and 10 to slide. A cover 12 is arranged at a position on the press plate 8 in such a manner that the cover 12 covers the pair of nip plates 9 and 10 and extends across the nip plates 9 and 10.

In this embodiment, the press plate 8 has a rectangular shape, and the pair of nip plates 9 and 10 is arranged in parallel to a pair of opposing side edges of the press plate 8. One of the opposed side edges of the press plate 8 is attached to the frame 7 by a shaft 11 which extends in parallel to the nip plates, so that the press plate 8 swings around an axis of the shaft 11 and vertically reciprocates.

A slit (not shown) is formed in the press plate 8 in a direction across the central portion of the nip plates 9 and 10 at a right angle. A feed-screw 17 is attached to a lower surface of the press plate 8 through a pair of support members 16*a* and 16*b*. The feed-screw 17 extends in parallel to the slit. Each support member 16*a*, 16*b* has a bearing, and the feed-screw 17 is supported by the bearings for rotation around the shaft. The nip plates 9 and 10 are provided at their lower surfaces with extension portions 9*a* and 10*a*. Each extension portion 9*a*, 10*a* includes a through hole having a screw groove. The extension portions 9*a*, 10*a* project downward through the slit, and are engaged with the feed-screw 17 through the through hole. Directions of screws of the feed-screw 17 are different from each other on both sides of a position corresponding to the slit. Therefore, as the feed-screw 17 rotates, the pair of nip plates 9 and 10 can slide in directions toward and away from each other along the slit.

A vertical fixed plate 14 is mounted on a lower surface of the press plate 8 in a way that it is opposed to an end of the feed-screw 17 projecting from the support member 16*b*. A nip plate drive motor 13 is fixed to the fixed plate 14. A drive shaft 13*a* of the nip plate drive motor 13 is arranged below the feed-screw 17 in parallel thereto. A pulley 15 is mounted on the drive shaft 13*a* of the nip plate drive motor 13, and a pulley 18 is mounted on an end of the feed-screw 17 opposed thereto. An endless belt 19 is extended between the pulley 15 and the pulley 18. When the nip plate drive motor 13 is driven, the feed-screw 17 is rotated, and the pair of nip plates 9 and 10 slides along the slit. The nip plate drive motor 13 is controlled by the controller 30 (see FIG. 5).

In this embodiment, the nip plate drive mechanism is comprised of the slit, the feed-screw 17, the pulley 15, the pulley 18, the endless belt 19 and the nip plate drive motor 13.

The nip plate drive mechanism is not limited to the above structure, and can be applied to various structures using a hydraulic piston, electrical motor and so on.

The press plate elevating mechanism comprises a first elevation unit for vertically moving a first end X of the press plate 8 which is positioned at the top edge side of the book block 4, and a second elevation unit for vertically moving a second end Y of the press plate 8 which is positioned on the bottom edge side of the book block 4.

In this embodiment, a first elevation unit of the press plate elevating mechanism comprises a first stepping motor 20 arranged below a lower side of a first end X of the press plate 8 and mounted on the frame 7, a first plate cam 21 fixed to a drive shaft 20*a* of the first stepping motor 20, a first rod 28 projecting from a lower surface of the first end X of the press plate 8, and a first roller 22 attached to an end of the first rod 28 through a pin 23 and abutting against an edge of the first plate cam 21 from above. When the first stepping motor 20 is driven, the first plate cam 21 rotates, so that the first rod 28 moves vertically, and the first end X of the press plate 8 moves vertically.

The second elevation unit of the press plate elevating mechanism comprises a second stepping motor 24 arranged below the second end Y of the press plate 8 and mounted on the frame 7, a second plate cam 25 fixed to a drive shaft 24*a* of the second stepping motor 24, a second rod 29 projecting from a lower surface of the second end Y of the press plate 8, and a second roller 26 attached to a tip end of the second rod 29 by a pin 27 and abutting against an edge of the second plate cam 25 from above. When the second stepping motor 24 is driven, the second plate cam 25 rotates, so that the second rod 29 moves vertically, and the second end Y of the press plate 8 moves vertically.

Figure 5:
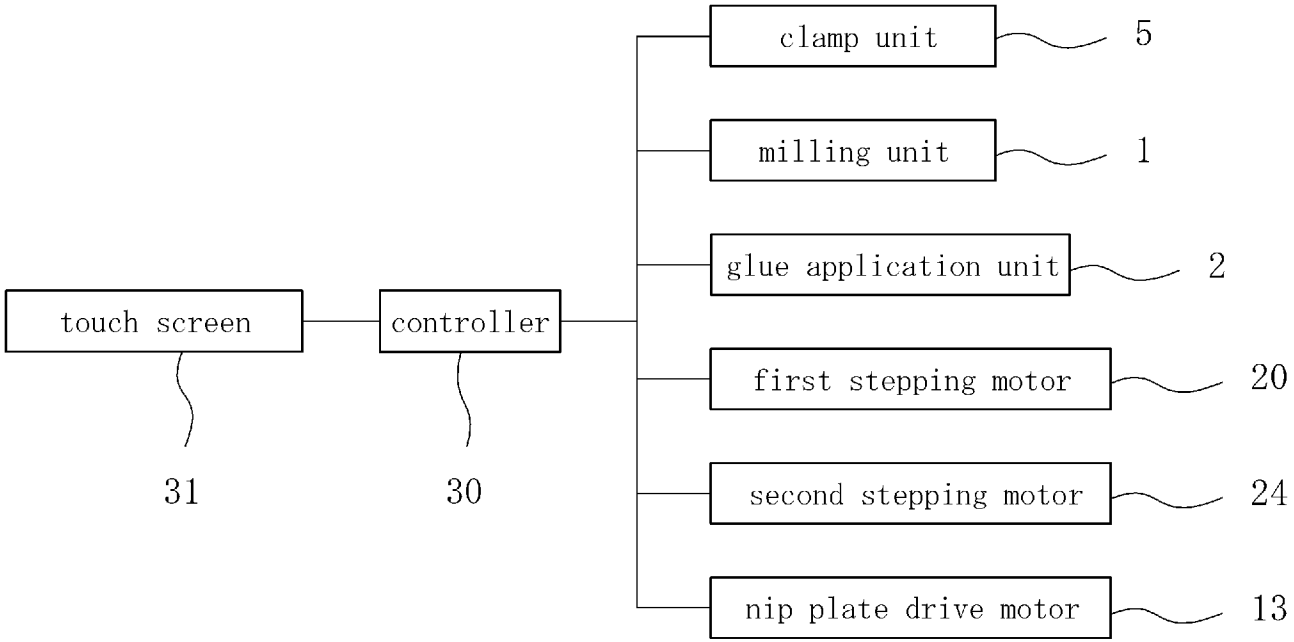
FIG. 5 is a block diagram showing a control system of the book binding apparatus for perfect book binding.

The first and second stepping motors 20 and 24 are separately controlled by the controller 30 (see FIG. 5). Thus the height of the first and second ends X and Y of the press plate 8 at the upper press position can be set separately by separately setting the amount of rotation of the first and second stepping motors 20 and 24, that is, rotation angles of the first and second plate cams 21 and 25.

If the height of the first and second ends X and Y does not need to set separately, the press plate elevating mechanism can be constructed by one stepping motor, one plate cam and so on. The press plate elevating mechanism is not limited to the above structure, and can be applied to various structures using a hydraulic piston, electrical motor and so on.

[Movement]

When the clamp unit 5 is positioned at a book block insertion unit 3 (one end of a guide rail 6) as shown in FIG. 1, the first and second stepping motors 20 and 24 receives a control signal from the controller 30 and are driven so as to move the press plate 8 to an alignment position between the lower standby position and the upper press position. The book block 4 is then inserted into the clamp unit 5 in such a manner that the lower end surface (the back surface) of the book block 4 is directed downward, and the book block 4 is positioned by abutting the back surface against the press plate 8 positioned at the alignment position. Thereafter, the book block 4 is clamped by the clamp unit 5 at both sides thereof. In this case, the height of the alignment position of the press plate 8 can be easily adjusted by adjusting the amount of rotation of the drive shafts of the first and second stepping motors 20 and 24. Therefore, even if there is no mechanism which adjusts heights of the milling machine 1*a* and the grinding blade 1*b* of the milling unit 1 and adjusts heights of the glue tank 2*a* and the gluing drum 2*b* of the glue application unit 2, it is possible to easily adjust these heights with respect to the back surface of the book block 4 when the book block 4 is clamped by the clamp unit 5, and to adjust the amount of grinding of the book block 4 and the amount of glue to be applied to the book block 4.

The press plate 8 is then lowered to the lower standby position from the alignment position, the book block 4 clamped by the clamp unit 5 is moved from the book block insertion unit 3 to the other end of the guide rail 6 through the glue application unit 2 as shown in FIG. 2. During this motion, the back surface of the book block 4 is uniformly grinded, and the inclined grooves are formed in the grinded surface with a given pitch. The glue tank 2*a* and the gluing drum 2*b* of the glue application unit 2 are lowered to positions retreated from the book block 4.

When the clamp unit 5 reaches the other end of the guide rail 6, the cover 12 is arranged at a position on the press plate 8 of the cover attachment unit 3, and the glue tank 2*a* and the gluing drum 2*b* of the glue application unit 2 are moved upward to the positions where they engage with the book block 4. The book block 4 clamped by the clamp unit 5 is moved from the milling unit 1 to the cover attachment unit 3 through the glue application unit 2. During this motion, reversely inclined new grooves are formed on the back surface of the book block 4 with a given pitch in the milling unit 1, and glue is applied to the back surface of the book block 4 by the glue application unit 2.

Figure 7:
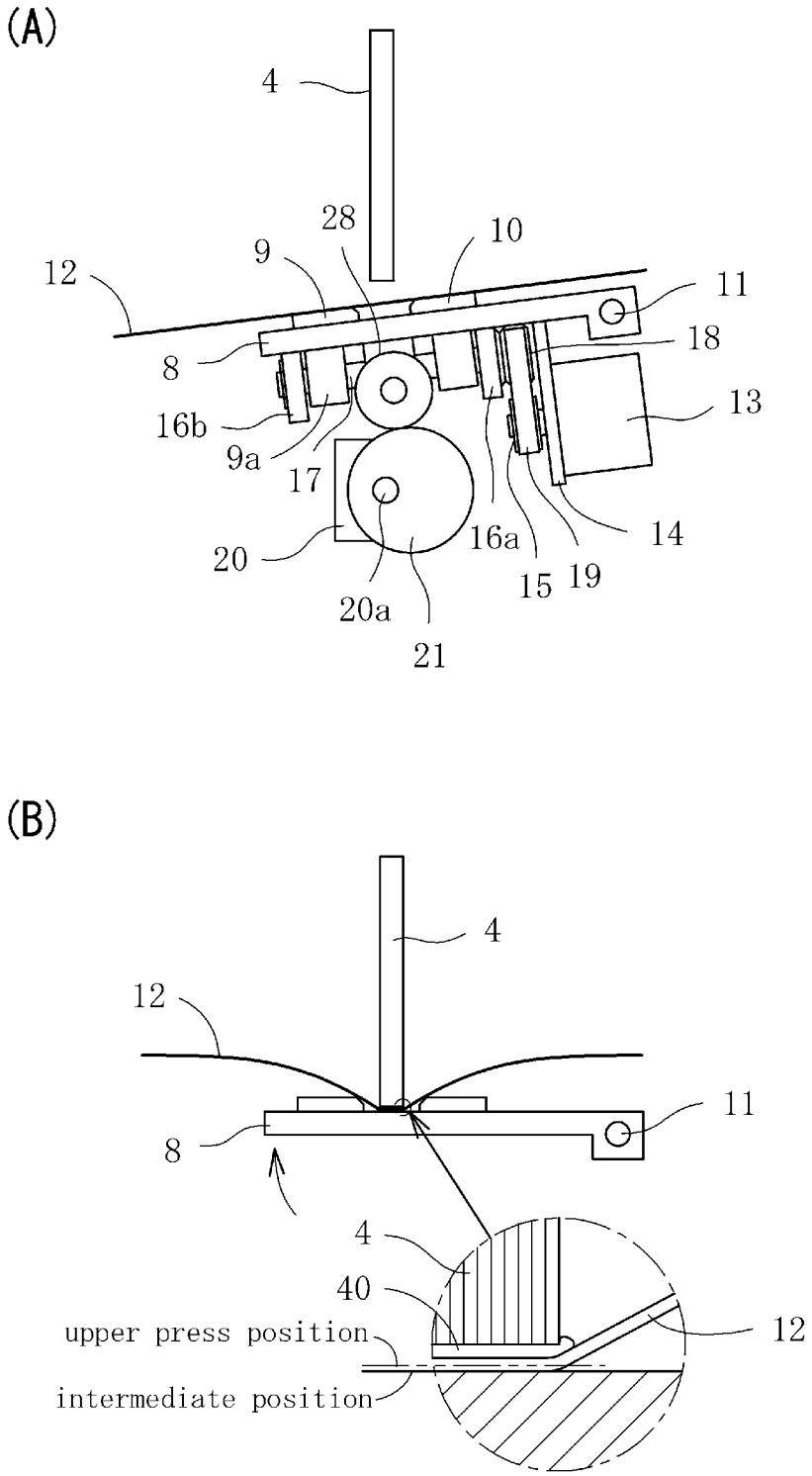
FIG. 7A is a side view showing the machine when a press plate is positioned at the lower standby position.
FIG. 7B is a side view showing the machine when a press plate is positioned at an intermediate position.
Figure 8:
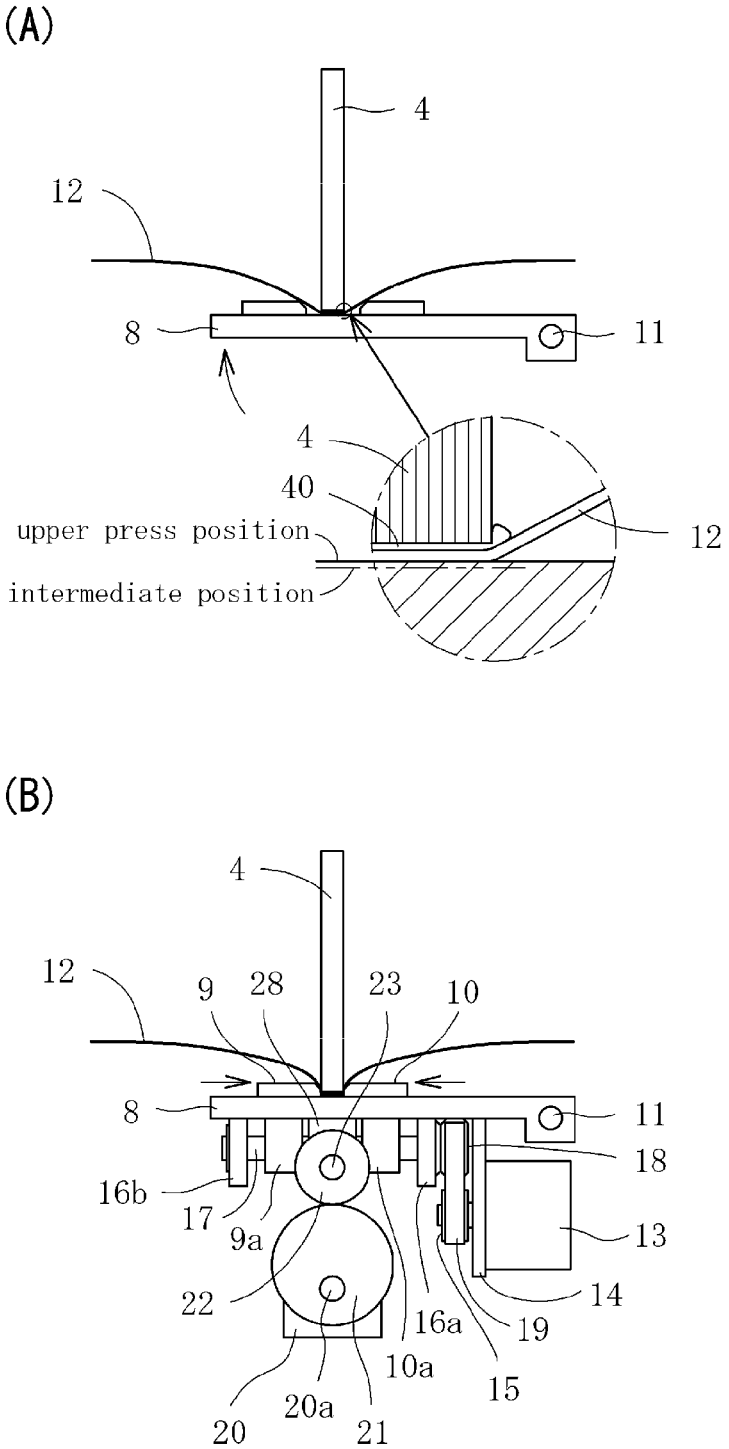
FIG. 8A is a side view showing the machine when a press plate is positioned at the upper press position.
FIG. 8B is a side view showing the machine when a pair of nip plates nip both a book block and a cover.
Figure 9:
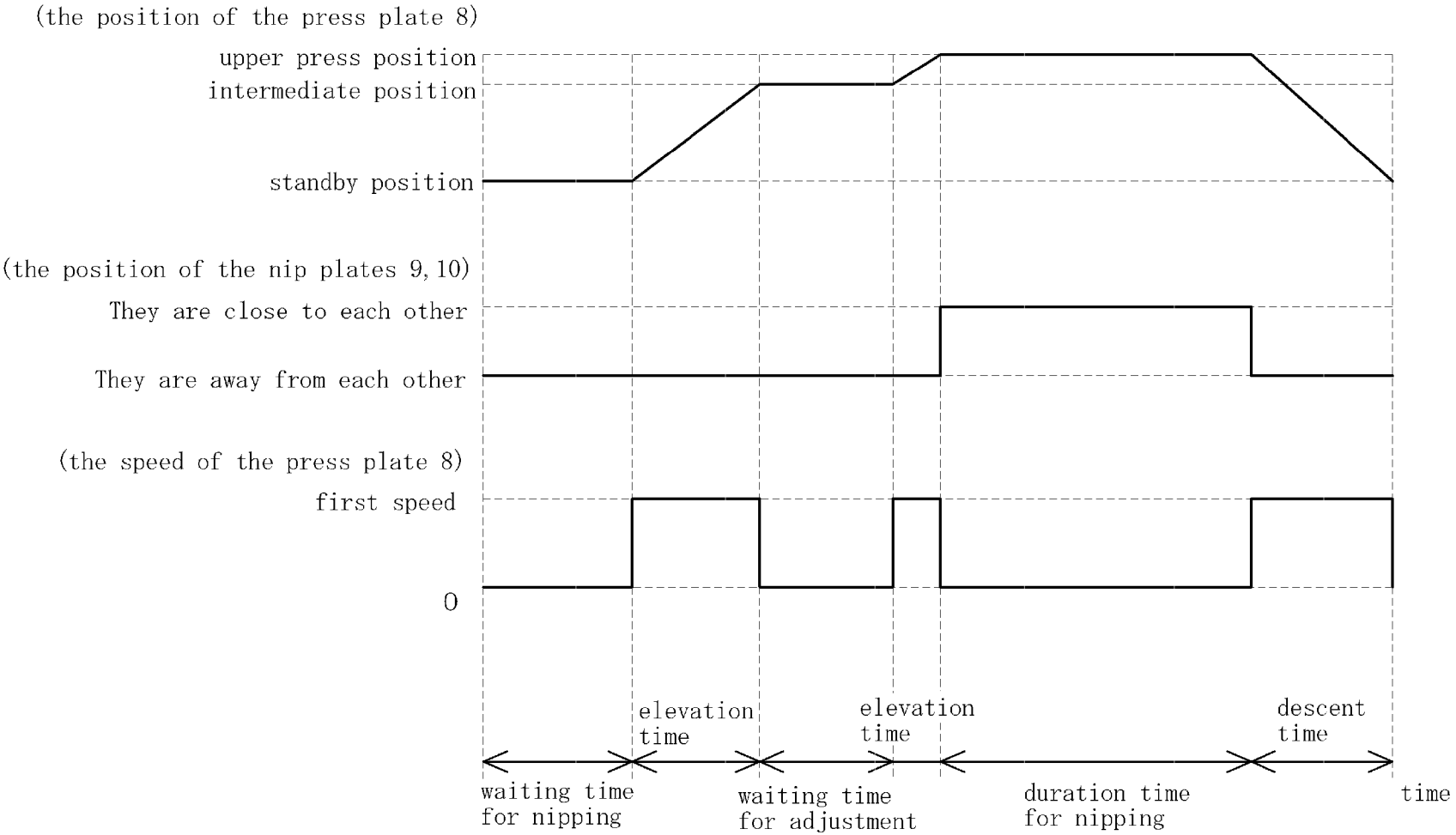
FIG. 9 is a time chart showing a movement of both the press plate and nip plates in a cover attachment process of the first embodiment.
Figure 10:
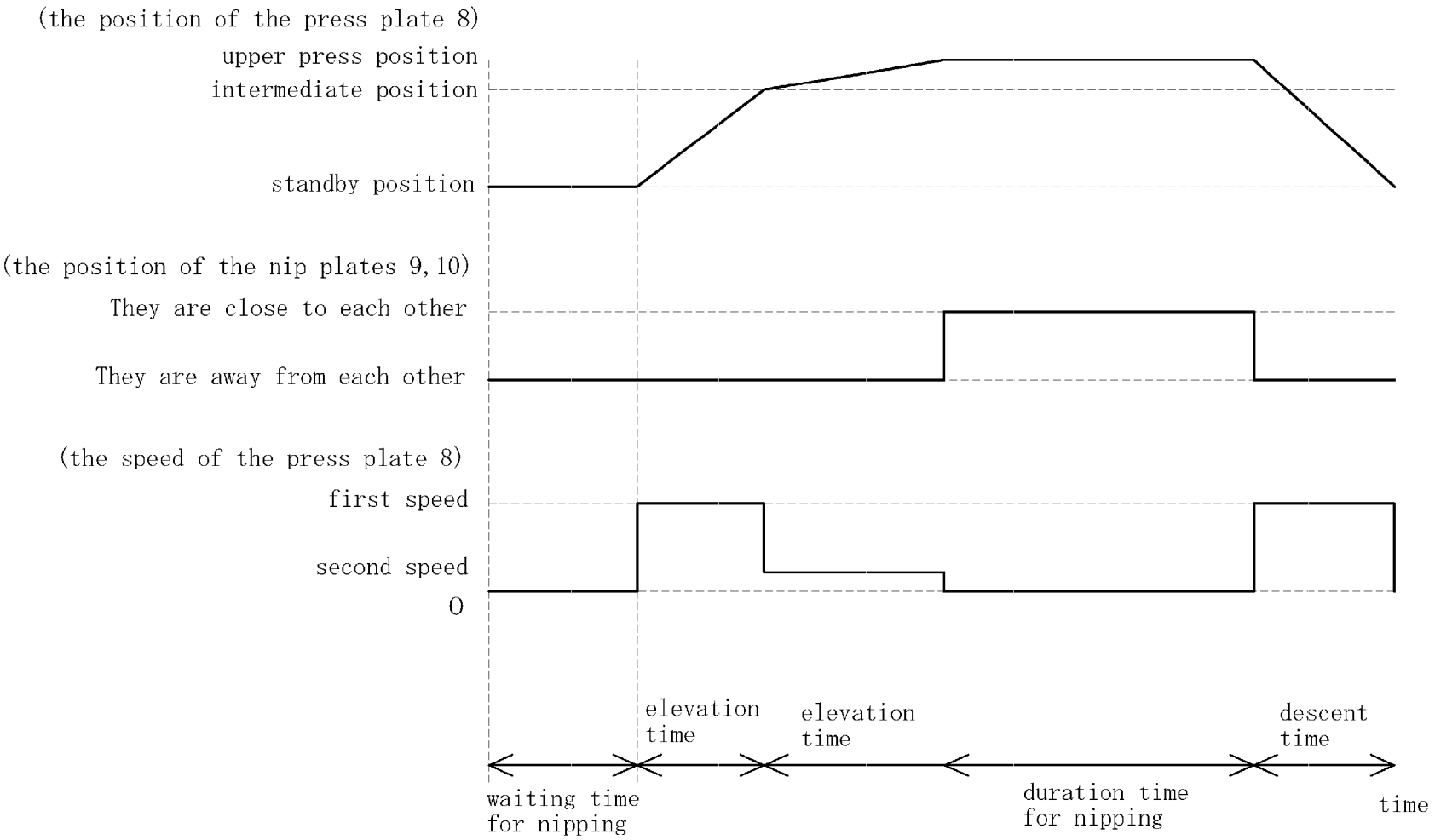
FIG. 10 is a time chart showing a movement of both the press plate and nip plates in a cover attachment process of the second embodiment.
Figure 11:
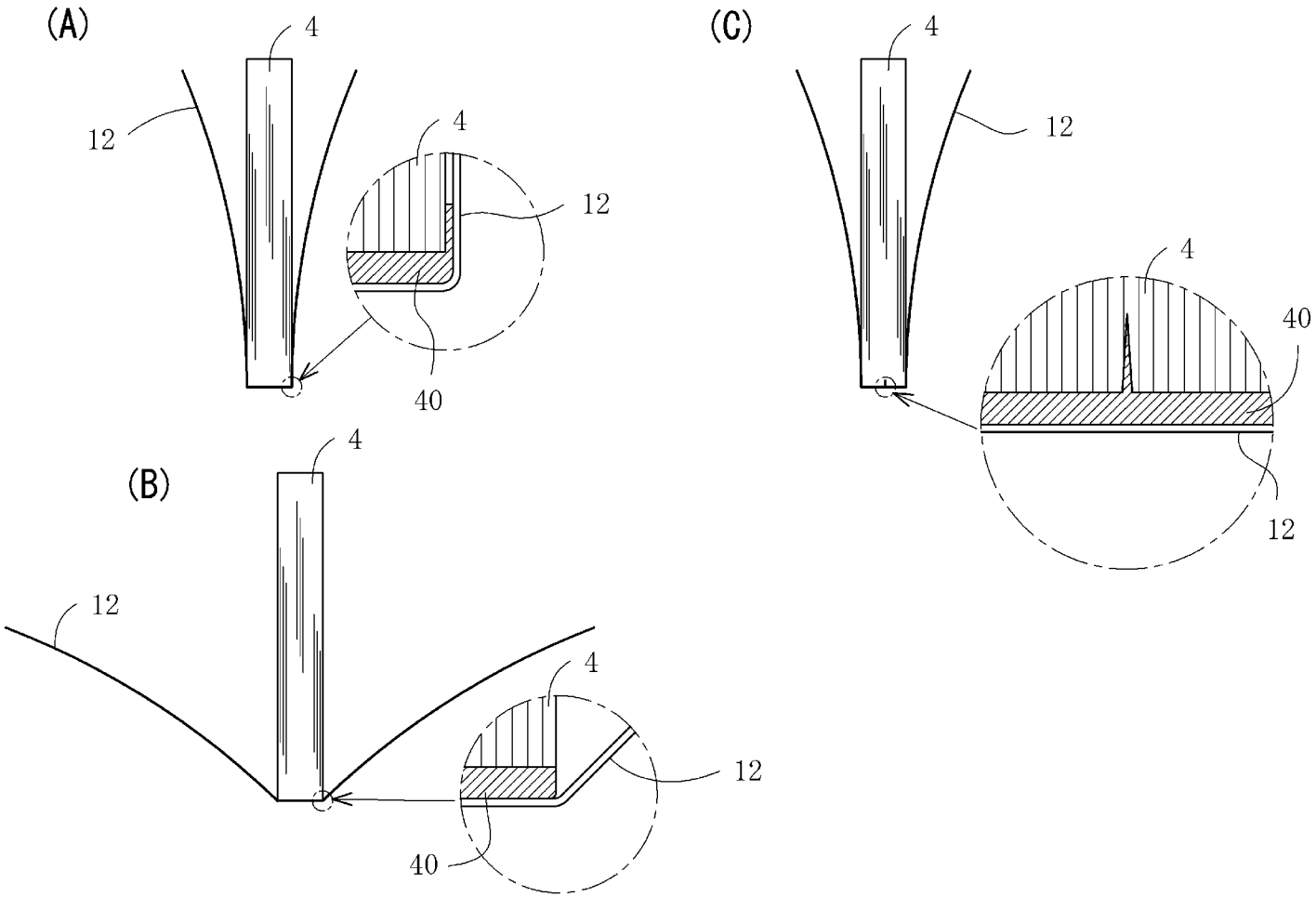
FIG. 11A is an explanatory view showing an excellent finished book.
FIG. 11B is an explanatory view showing a finished book with glue applied only to the lower end surface of the book block.
FIG. 11C is an explanatory view showing a finished book with glue entered into the book block.

Next, a cover attachment process of attaching a cover to a book block will be explained below with reference to FIGS. 7 to 9.

As shown in FIG. 7A, in the cover attachment unit 3, the book block 4 clamped by the clamp unit 5 is arranged in such a manner that the back surface with the glue is positioned above a gap between the pair of nip plates 9 and 10 to face the gap. At this time, the press plate 8 is disposed at the lower standby position. The press plate 8 stays at the lower standby position until a time (a waiting time for nipping) passes away from a time when the book block 4 is disposed above the gap between the nip plates 9 and 10, so that the glue applied to the lower end surface of the book block 4 is dried at a predetermined cure degree.

Thereafter, as shown in FIG. 7B, the controller 30 sends a control signal to the first and second stepping motors 20 and 24, and the press plate 8 is moved upward from the lower standby position to an intermediate position together with the nip plates 9 and 10. The press plate 8 stays at the intermediate position during a waiting time for adjustment.

The cover 12 is pressed against the back surface of the book block 4 by the press plate 8 at the intermediate position during the waiting time for adjustment, and the glue applied to the lower end surface of the book block 4 is appropriately extruded to the both sides of the lower end portion of the book block 4.

The intermediate position is between the lower standby position and the upper press position. Furthermore, the intermediate position is considerably close to the upper press position. The intermediate position is disposed below the upper press position at for example 0.1 to 0.8 mm. The waiting time for adjustment is for example 2 to 6 seconds. The intermediate position and the waiting time for adjustment are set depending on the amount and the viscosity of the glue, the ambient temperature and so on.

Thereafter, as shown in FIG. 8A, the controller 30 sends a control signal to the first and second stepping motors 20 and 24, and the press plate 8 is moved upward from the intermediate position to the upper press position together with the nip plates 9 and 10 and stopped. Then, the cover 12 is pressed against the lower end surface of the book block 4 by the press plate 8, and attached to the lower end surface of the book block 4 with the glue 40.

Then as shown in FIG. 8B, the controller 30 sends a control signal to the nip plate drive motor 13, and the nip plates 9 and 10 move toward each other and nip the lower end portion of the book block 4 together with the cover 12 at the both sides thereof. And the cover 12 is attached to the both sides of the lower end portion of the book block 4 with the glue 40. Therefore, the press plate 8 stays at the upper press position during a duration time for nipping while the nip plates 9 and 10 nip both the book block 4 and the cover 12.

And then, the nip plates 9 and 10 move away from each other, the press plate 8 lowers from the upper press position to the lower standby position, whereby the cover attachment process is completed.

As above stated, the press plate 8 stays during the waiting time for adjustment at the intermediate position adjacent to the upper press position, as a result the glue 40 applied to the lower end surface of the book block 4 is appropriately extruded to the both sides of the lower end portion of the book block 4. At the same time, the press plate 8 is elevated from the intermediate position to the upper press position after the glue 40 is extruded to the both sides of the lower end portion of the book block 4, whereby the press plate 8 is prevented from elevating with a great amount of the glue 40 applied to the lower end surface of the book block 4. The glue 40 applied to the lower end surface of the book block 4 is not rapidly subjected to an extra pressure. The glue 40 can be prevented from being entered into the book block 4.

Figure 6:
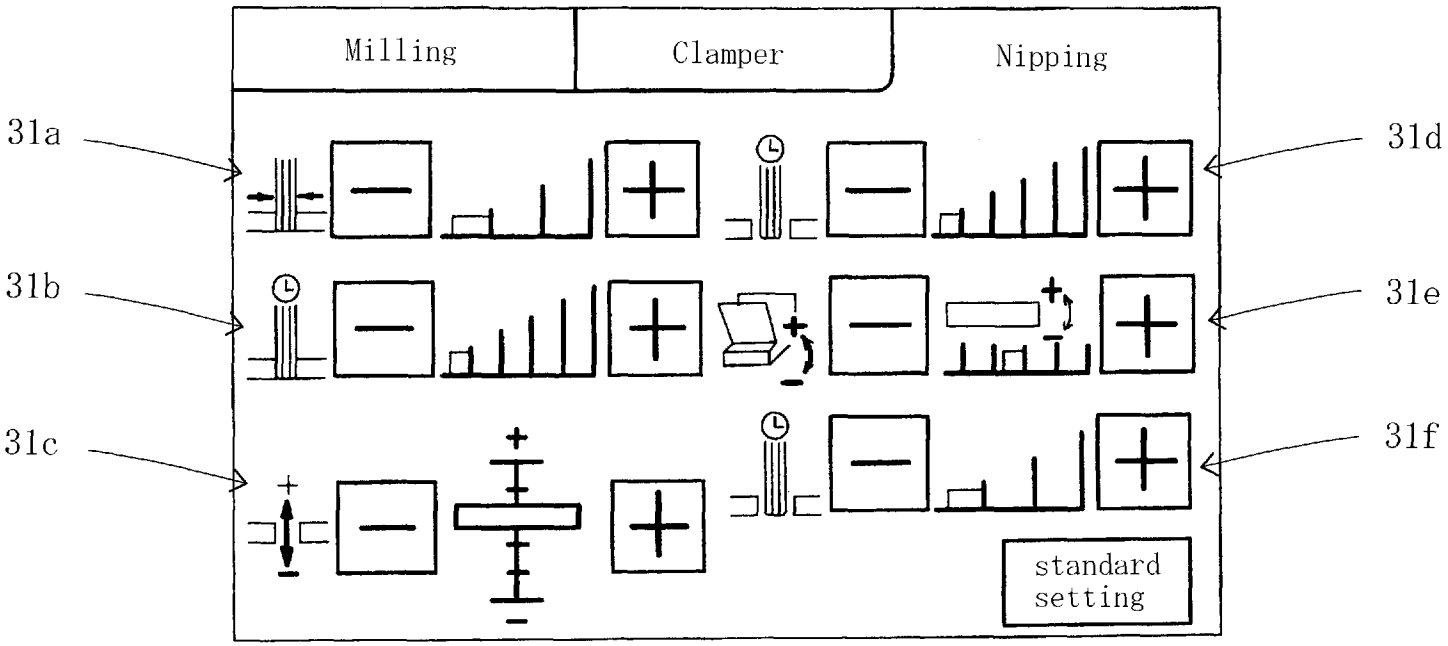
FIG. 6 is a plan view showing a screen displayed on a touch screen provided on the controller of the machine.

In this embodiment, the controller 30 includes a touch screen 31 as shown in FIG. 5. The touch screen 31 displays a setting display area for setting various parameter and/or command required for operation of the book binding apparatus. In FIG. 6, one example of the setting display area on the touch screen 31 is shown. In FIG. 6, the setting display areas for the milling operation, the clamping operation and the nipping operation can be changed by switching tags of "Milling", "Clamper" and "Nipping".

As shown in FIG. 6, the setting display area for the nipping operation has a screen area 31*a* for setting a clamp pressure of the nip plates 9 and 10, a screen area 31*c* for setting a height of an alignment position of the press plate 8, and a screen area

31*e* for setting inclination of the press plate 8 at the upper press position when thicknesses between the back side and the bottom edge side of the book block 4 are different from each other.

Further, the setting display area for the nipping operation has a screen area 31*b* for setting the duration time for nipping, a screen area 31*d* for setting the waiting time for nipping, and a screen area 31*f* for setting the waiting time for adjustment.

Each of the screen areas 31*a* to 31*f* has a "+" button for increasing a set value and a "–" button for decreasing the set value. The set values can be easily inputted by pressing these buttons. For example, in the screen area 31*f*, the waiting time for adjustment can be increased (for example to 6 seconds) by pressing the "+" button, while the waiting time for adjustment can be decreased (for example to 2 seconds) by pressing the "–" button.

Although not shown in the drawings, a height of the alignment position of the press plate 8 of the book block insertion unit 3 can be set on the setting display area for the milling operation, and a clamp pressure of the clamp unit 5 and a speed of motion of the clamp unit 5 can be set on the setting display area for the clamping operation.

A set value inputted through the touch screen 31 is stored in a memory (not shown) of the controller 30. Based on the set value stored in the memory, the milling unit 1, the glue application unit 2 and the clamp unit 5 are controlled as well as the first and second stepping motors 20 and 24 and the nip plate drive motor 13.

In this embodiment, a height of the intermediate position is previously stored in the memory of the controller 30 (for example, a distance of 0.2 mm from the upper press position is stored). However, in another embodiment, a screen area for setting the height of the intermediate position can be provided on the setting display area for the nipping operation, and operator can set the height of the intermediate position.

The Second Embodiment

Next, the second embodiment of the machine according to the present invention will be explained below. In order to avoid explaining redundantly, the difference between the first and second embodiments will be explained below.

A cover attachment process of attaching a cover to a book block will be explained below with reference to FIGS. 7 to 9.

As shown in FIG. 7A, in the cover attachment unit 3, the book block 4 clamped by the clamp unit 5 is arranged in such a manner that the back surface with the glue is positioned above a gap between the pair of nip plates 9 and 10 to face the gap. At this time, the press plate 8 is disposed at the lower standby position. The press plate 8 stays at the lower standby position until a time (a waiting time for nipping) passes away from a time when the book block 4 is disposed above the gap between the nip plates 9 and 10, and the glue applied to the lower end surface of the book block 4 can be dried at a predetermined cure degree.

Thereafter, as shown in FIG. 7B, the controller 30 sends a control signal to the first and second stepping motors 20 and 24, and the press plate 8 is moved upward from the lower standby position to the intermediate position together with the nip plates 9 and 10 at a first speed.

The cover 12 is pressed against the back surface of the book block 4 by the press plate 8 at the intermediate position so that the glue applied to the lower end surface of the book block 4 is appropriately extruded to the both sides of the lower end portion of the book block 4.

The intermediate position is between the lower standby position and the upper press position. Furthermore, the intermediate position is considerably close to the upper press position. The intermediate position is disposed below the upper press position at for example 0.1 to 0.8 mm.

Thereafter, as shown in FIG. 8A, the controller 30 sends a control signal to the first and second stepping motors 20 and 24, and the press plate 8 is moved upward from the intermediate position to the upper press position together with the nip plates 9 and 10 and stopped. Then, the cover 12 is pressed against the lower end surface of the book block 4 by the press plate 8, and attached to the lower end surface of the book block 4 with the glue 40.

The press plate 8 is moved upward from the intermediate position to the upper press position at a second speed. The second speed is set to be considerably lower than the first speed. For example, the second speed is 5 to 20% of the first speed.

Thereafter, as shown in FIG. 8B, the controller 30 sends a control signal to the nip plate drive motor 13, and the nip plates 9 and 10 move toward each other and nip the lower end portion of the book block 4 together with the cover 12 at the both sides thereof. And the cover 12 is attached to the both sides of the lower end portion of the book block 4 with the glue 40. Therefore, the press plate 8 stays at the upper press position during the duration time for nipping when the nip plates 9 and 10 nip both the book block 4 and the cover 12.

Thereafter, the nip plates 9 and 10 move away from each other, the press plate 8 lowers from the upper press position to the lower standby position, whereby the cover attachment process is completed.

As above stated, the press plate 8 is moved upward from the intermediate position adjacent to the upper press position to the upper press position at the considerably slower second speed, and the glue 40 applied to the lower end surface of the book block 4 is appropriately extruded to the both sides of the lower end portion of the book block 4. At the same time, the glue 40 is gradually extruded to the both sides of the lower end portion of the book block 4 while the press plate 8 is elevated from the intermediate position to the upper press position, whereby the press plate 8 is prevented from elevating with a great amount of the glue 40 applied to the lower end surface of the book block 4. The glue 40 applied to the lower end surface of the book block 4 is not rapidly subjected to an extra pressure. The glue 40 can be prevented from being entered into the book block 4.

Although not shown in the drawings, the setting display area for the nipping operation has a screen area for setting the second speed. In the screen area, the second speed can be increased (for example 20% of the first speed) by pressing the "+" button, while the second speed can be decreased (for example 5% of the first speed) by pressing the "–" button.

In the above-mentioned embodiment, the machine for attachment of the cover to the book block of the present invention may be not only applied to the cover attachment unit of the book binding apparatus for perfect book binding, but also used as a single apparatus for attachment of a cover to a book block.

DESCRIPTION OF THE REFERENCE CHARACTERS

1 milling unit
2 glue application unit
3 cover attachment unit
4 book block
5 clamp unit
6 slide guide
7 frame

8 press plate
9, 10 a pair of nip plates
12 cover
10 controller
31 touch screen
40 glue

The invention claimed is:

1. A machine for attachment of a cover to a book block, comprising:

a frame;

a press plate attached to the frame to be vertically reciprocated between a lower standby position and an upper press position;

a press plate elevating mechanism attached to the flame for elevating the press plate;

a pair of nip plates disposed in parallel to each other on an upper surface of the press plate to be slid toward and away from each other;

a nip plate drive mechanism attached to the press plate for sliding the nip plates;

a clamp unit mounted on the frame for clamping a book block at both side thereof in such a way that a back surface of the book block to which glue is previously applied is directed downward, the clamp unit positioning the book block above a gap between the plates in such a way that the back surface of the book block is opposed to the gap, a cover being arranged over the press plate; and a controller controlling the press plate elevating mechanism and the nip plate drive mechanism, whereby the press plate together with the nip plates elevates from the lower standby position to an intermediate position adjacent to the upper press position, the press plate stays at the intermediate position during a waiting time for adjustment, the press plate together with the nip plates elevates from the intermediate position to the upper press position, and then the nip plates move toward each other so as to attach the cover to the book block.

2. The machine according to claim 1, wherein the controller includes a touch screen for receiving an input of a value of the waiting time for adjustment to control the press plate mechanism.

3. A machine for attachment of a cover to a book block, comprising:

a frame;

a press plate attached to the frame to be vertically reciprocated between a lower standby position and an upper press position;

a press plate elevating mechanism attached to the flame for elevating the press plate;

a pair of nip plates disposed in parallel to each other on an upper surface of the press plate to be slid toward and away from each other;

a nip plate drive mechanism attached to the press plate for sliding the nip plates;

a clamp unit mounted on the frame for clamping a book block at both side thereof in such a way that a back surface of the book block to which glue is previously applied is directed downward, the clamp unit positioning the book block above a gap between the plates in such a way that the back surface of the book block is opposed to the gap, a cover being arranged over the press plate; and a controller controlling the press plate elevating mechanism and the nip plate drive mechanism, whereby the press plate together with the nip plates elevates from the lower standby position to an intermediate position adjacent to the upper press position at a first speed, wherein the intermediate position is a position where the glue applied to the back surface of the book block is extruded to the both sides of the back surface of the book block when the cover is pressed against the back surface of the book block by the press plate, the press plate together with the nip plates elevates from the intermediate position to the upper press position at a second speed lower than the first speed, and then the nip plates move toward each other so as to attach the cover to the book block.

4. The machine according to claim 3, wherein the controller includes a touch screen for receiving an input of a value of the second speed to control the press plate elevating mechanism.

5. A book binding apparatus comprising:

a milling unit for grinding the back surface of the book block;

a glue application unit for applying glue to the back surface of the book block grinded by the milling unit; and a cover attachment unit comprising the machine for attachment of the cover to the book block according to claim 1, the cover attachment unit attaching the cover to the back surface of the book block to which the glue is applied by the glue application unit, the milling unit, the glue application unit and the cover attachment unit being sequentially arranged in a line, the cover attachment unit having the function of a book block insertion unit for setting the book block in the clamp unit, the clamp unit being guided by a slide guide arranged in parallel to the line to the line of the milling unit, the glue application unit and the cover attachment unit having the function of the book block insertion unit to reciprocate between the milling unit and the cover attachment unit, the book block being inserted to the clamp unit, the back surface of the book block being positioned by being abutted against the press plate when the clamp unit is positioned at the book block insertion unit, the back surface of the book block being then clamped by the clamp unit and moved to the milling unit from the book block insertion unit beyond the glue application unit, the book block being then moved from the milling unit to the cover attachment unit through the glue application unit, the back surface of the book block being processed by the grinding, applied with the glue and attached with the cover during the movement.

6. A book binding apparatus comprising:

a milling unit for grinding the back surface of the book block;

a glue application unit for applying glue to the back surface of the book block grinded by the milling unit; and a cover attachment unit comprising the machine for attachment of the cover to the book block according to claim 2, the cover attachment unit attaching the cover to the back surface of the book block to which the glue is applied by the glue application unit, the milling unit, the glue application unit and the cover attachment unit being sequentially arranged in a line, the cover attachment unit having the function of a book block insertion unit for setting the book block in the clamp unit, the clamp unit being guided by a slide guide arranged in parallel to the line to the line of the milling unit, the glue application unit and the cover attachment unit having the function of the book block insertion unit to reciprocate between the milling unit and the cover attachment unit, the book block being inserted to the clamp unit, the back surface of the book block being positioned by being abutted against the press plate when the clamp unit is positioned at the book block insertion unit, the back surface of the book block being then clamped by the clamp unit and moved to the milling unit from the book block insertion unit beyond the glue application unit, the book block being then moved from the milling unit to the cover attachment unit through the glue application unit, the back surface of the book block being processed by the grinding, applied with the glue and attached with the cover during the movement.

7. A book binding apparatus comprising:

a milling unit for grinding the back surface of the book block;

a glue application unit for applying glue to the back surface of the book block grinded by the milling unit; and a cover attachment unit comprising the machine for attachment of the cover to the book block according to claim 3, the cover attachment unit attaching the cover to the back surface of the book block to which the glue is applied by the glue application unit, the milling unit, the glue application unit and the cover attachment unit being sequentially arranged in a line, the cover attachment unit having the function of a book block insertion unit for setting the book block in the clamp unit, the clamp unit being guided by a slide guide arranged in parallel to the line to the line of the milling unit, the glue application unit and the cover attachment unit having the function of the book block insertion unit to reciprocate between the milling unit and the cover attachment unit, the book block being inserted to the clamp unit, the back surface of the book block being positioned by being abutted against the press plate when the clamp unit is positioned at the book block insertion unit, the back surface of the book block being then clamped by the clamp unit and moved to the milling unit from the book block insertion unit beyond the glue application unit, the book block being then moved from the milling unit to the cover attachment unit through the glue application unit, the back surface of the book block being processed by the grinding, applied with the glue and attached with the cover during the movement.

8. A book binding apparatus comprising:

a milling unit for grinding the back surface of the book block;

a glue application unit for applying glue to the back surface of the book block grinded by the milling unit; and a cover attachment unit comprising the machine for attachment of the cover to the book block according to claim 4, the cover attachment unit attaching the cover to the back surface of the book block to which the glue is applied by the glue application unit, the milling unit, the glue application unit and the cover attachment unit being sequentially arranged in a line, the cover attachment unit having the function of a book block insertion unit for setting the book block in the clamp unit, the clamp unit being guided by a slide guide arranged in parallel to the line to the line of the milling unit, the glue application unit and the cover attachment unit having the function of the book block insertion unit to reciprocate between the milling unit and the cover attachment unit, the book block being inserted to the clamp unit, the back surface of the book block being positioned by being abutted against the press plate when the clamp unit is positioned at the book block insertion unit, the back surface of the book block being then clamped by the clamp unit and moved to the milling unit from the book block insertion unit beyond the glue application unit, the book block being then moved from the milling unit to the cover attachment unit through the glue application unit, the back surface of the book block being processed by the grinding, applied with the glue and attached with the cover during the movement.

* * * * *